US006902214B2

(12) United States Patent
Smith

(10) Patent No.: US 6,902,214 B2
(45) Date of Patent: Jun. 7, 2005

(54) ELECTROMECHANICAL LOCKING METHOD AND DEVICE

(76) Inventor: Jerry R. Smith, 5690 W. Rowland Ave., Littleton, CO (US) 80128

( * ) Notice: Subject to any disclaimer, the term of this patent is extended or adjusted under 35 U.S.C. 154(b) by 0 days.

(21) Appl. No.: 10/275,056

(22) PCT Filed: Jun. 19, 2001

(86) PCT No.: PCT/US01/19527

§ 371 (c)(1),
(2), (4) Date: Oct. 30, 2002

(65) Prior Publication Data

US 2004/0026933 A1 Feb. 12, 2004

(51) Int. Cl.[7] ..... E05C 19/16
(52) U.S. Cl. ..... 292/251.5; 292/341.16
(58) Field of Search ..... 292/251.5, 341.16, 292/25, 92, 96, DIG. 53, DIG. 61; 24/303

(56) References Cited

U.S. PATENT DOCUMENTS

| | | | | | |
|---|---|---|---|---|---|
| 2,435,729 | A | * | 2/1948 | Whann et al. | 119/426 |
| 3,201,960 | A | * | 8/1965 | Berkowitz | 70/150 |
| 3,736,779 | A | * | 6/1973 | Pratt | 70/276 |
| 4,850,623 | A | * | 7/1989 | Franklin et al. | 292/144 |
| 4,915,431 | A | * | 4/1990 | Bailey | 292/251.5 |
| 5,184,855 | A | * | 2/1993 | Waltz et al. | 292/251.5 |
| 5,516,166 | A | * | 5/1996 | Frolov et al. | 292/251.5 |
| 5,641,187 | A | * | 6/1997 | Frolov | 292/251.5 |
| 5,897,149 | A | * | 4/1999 | Frolov | 292/251.5 |
| 6,092,846 | A | * | 7/2000 | Fuss et al. | 292/302 |
| 6,260,892 | B1 | * | 7/2001 | Chang | 292/251.5 |
| 6,554,326 | B1 | * | 4/2003 | Goldman | 292/144 |
| 6,609,738 | B1 | * | 8/2003 | Roth et al. | 292/251.5 |
| 2003/0164614 | A1 | * | 9/2003 | Fly | 292/25 |

FOREIGN PATENT DOCUMENTS

| | | | |
|---|---|---|---|
| FR | 2722232 | A1 * | 1/1996 |
| GB | 2123472 | A1 * | 2/1984 |
| GB | 0260860 | A1 * | 3/1988 |

* cited by examiner

*Primary Examiner*—Robert J. Sandy
*Assistant Examiner*—Andre' L. Jackson
(74) *Attorney, Agent, or Firm*—Timothy J. Martin; Michael R. Henson; Rebecca A. Gegick

(57) ABSTRACT

An electromechanical lock includes a latching assembly secured to a first structure, a catch piece secured to a second structure, and an electromechanical device. The latching assembly includes at least one latch element movable between a capture and release states to mechanically engage and disengage the catch piece, an arming member movable between a first and second positions wherein the latch element is released and captured, and a biasing element to urge the arming member into the first position. When the electromagnetic device is switched "on", it magnetically engages the arming member with sufficient force to overcome the biasing force whereby movement of the catch piece away from the received state results in the latch element moving into the capture state to prevent separation of the first and second structures; when the electromagnetic device is switched "off", the first and second structures may be separated.

45 Claims, 10 Drawing Sheets

ELECTROMECHANICAL LOCKING METHOD AND DEVICE

FIELD OF THE INVENTION

The present invention broadly concerns locking methods and systems. More particularly, the present invention is directed to electromechanical devices that may be employed to secure two structures together which may otherwise move relatively apart from one another. The present invention is also directed to a method of a electromechanically locking two structures together. This invention is especially adapted for use in electromechanically locking a door.

BACKGROUND OF THE INVENTION

The ability to lockably secure two structures together to permit or prevent relative movement therebetween has been a goal of many locking systems. A plethora of different locking mechanisms have been developed over the course of history. These include key actuated locks, combination locks, code activated locks and the like.

Many types of locks are associated with doors in order to selectively lock a door in a closed position. Authorized personnel are provided with a key or combination to the lock so that they may selectively unlock the door and move it to an open position. In some instances, doors are locked in such a way as to allow monitored access. Here, a guard monitors the door to an entryway. When an authorized person seeks access, the guard initializes a switch which deactivates the lock so that the door can be opened. Such systems are often employed at offices for controlling employee access, in apartments, wherein a tenant may initialize a switch that deactivates the locking device to allow entrance of a guest into the building and other related applications.

One type of electrically controlled lock employs an electromagnet that is typically mounted to a door casing. A ferromagnetic armature is attached to the door and positioned so as to come in contact with the electromagnet device on the casing. The electromagnet is of such strength that a person may not readily open the door when the electromagnet is activated due to the strength of the magnetic attraction of the electromagnet for the armature. As security interests have heightened, it has become increasingly desirable that greater force be provided for these magnetic locks to secure the door and the casing. Accordingly, the strength of the electromagnets has been proportionately increasing. Such increase in strength, however, is not without its drawbacks. While some technological advances have been made in materials, it has been the usual case that increasing the strength of the electromagnet results in utilizing increasingly higher gauss magnets. This naturally increases the cost of the magnet as well as power consumption should the magnet be continuously energized with access being granted by de-energizing the magnet. In addition to these disadvantages, increasing the size of the electromagnet increases the size of the assembly secured to the door casing.

The present invention addresses these disadvantages by providing an electromechanical locking system and method that utilizes an electromagnet in conjunction with mechanical structure to accomplish the selective locking of two structures together. Thus, it is able to provide a high strength of resistant to breach while at the same time reducing the size of the electromagnetic device.

SUMMARY OF THE INVENTION

It is an object of the present invention to provide a new and useful electromagnetic lock that may be used to secured two structures, such as a door and its casing, together while permitting the structures to be moved apart from one another as desired.

Another object of the present invention is to provide a new and useful electromechanical locking system which can be employed, for example, with security doors as well as a door employing such electromechanical lock.

It still a further object of the present invention to provide a new and useful method for electromechanically locking first and second structures together.

A further object of the present invention is to provide an electromechanical locking structure that can be produced at a reduced size and cost while maintaining a high locking strength.

According to the present invention, then, an electromechanical lock is adapted to selectively permit first and second structures from moving apart from one another when in a first state and to prevent said first and second structures from moving apart when in a second state. Broadly, the electromechanical lock includes a latching assembly adapted to mount to the first structure and a catch piece adapted to mount to the second structure. The latching assembly and the catch structure are positionable such that the catch piece can be docked in a receive state in the latching assembly.

The latching assembly includes at least one latch element movable between a capture state wherein the catch piece becomes mechanically engaged thereby and a release state wherein the catch piece is disengaged thereby. The latching assembly includes an arming member that is movable between a first position and a second position. The arming member, when in the first position, engages the latch element whereby the latch element is in the release state. The arming member, when in the second position, permits the latch element to move into the capture state. The latching assembly includes a biasing element associated with the arming member that is operative to urge the arming member into the first position with the first force.

The invention also includes an electromagnetic device that is switchable between an "on" condition and a "off" condition. This electromagnetic device is operative to magnetically co-engage the arming member and the catch piece when the catch piece is in the received state and the electromagnetic device is in an "on" condition. This engagement is with a sufficient magnetic force to overcome the first force whereby movement of the catch piece away from the received state while the electromagnetic device is in the "on" condition results in the latch element moving into the capture state.

The electromagnetic lock of the present invention may be mounted in a housing that includes a base and a cover. When the cover is secured on the base, the housing has an interior with an entryway sized to receive the catch piece. The latch element is mounted for rotation within the housing. In one embodiment, the latching element has a pair of opposed projecting trunnions. A base wall portion of the housing and the cover are each in spaced-apart opposed relation to one another, and the base wall portion and the cover are each provided with seats for rotatably receiving and mounting the trunnions. A plurality of latch elements may be provided in the housing.

The latch element can take a variety of forms and may be operated in several different manners. In once instance, the latch element may be biased or in the capture state. The latch element can be formed as a pawl having a cam surface that acts to move said latch element between the release and capture state. This cam surface can be formed by an inclined plane portion on the latch element in which case the arming member includes a portion that slides along the inclined plane to allow the latch element to move between the release state and the capture state when the arming member moves between the first and second positions. The latch element can be formed as a pawl having a slotted opening. Here, the arming member can include a portion that is received in the slotted opening and acts to move the latch element between the release state and capture state when the arming member moves between the first and second positions. Preferably, the arming member is spring biased toward the first position.

The catch piece can be formed as a variety of structures, but one such structure is an armature plate that includes a lip portion operative to be engaged by the latch element when it is in the received state. The electromagnetic device can be secured to the arming element or to the catch piece. When secured to the arming element, the arming element can form a core for an electrically conductive coil so as to form part of the electromagnetic device.

The electromechanical lock of the present invention, while useful for preventing and permitting any two suitable structures from moving apart from one another, it is especially adapted to selectively permit the locking of a door in its casing. Thus, the present invention is also directed to an access door for an opening in a structure. Here, the access door includes a casing adapted to mount in the opening and a door adapted to mount in a casing and movable between an open state and a closed state. The invention then includes electromechanical lock described generally above.

The electromechanical lock, as generally described above, can also be employed in a electromechanical locking system that is adapted to connect to a source of electrical power and to selectively permit one or more first and second structures from moving apart from one another when in a first state and to prevent the structures from moving apart from one another when in a second state. This locking system includes one or more electromechanical locks, as generally described above, as well as a controller that is operative to selectively switch electromechanical lock(s) between the "on" and the "off" state.

Finally, the present invention also includes a method for electromechanically locking first and second structures together. The method broadly includes a first step of mounting a latching means including at least one of mechanical latch element onto a first structure with this latch element movable between a capture state and a release state. The method includes the step of biasing the latching element into the release state with a first force. The method also includes the step of mounting a catch means on the second structure. The method encompasses the docking of the catch means with the latch means together in a received state and mechanically coupling the latch element and the catch means with an electromagnetic device that is switchable between a "on" condition and a "off" condition. Thus, when electromechanical device in a "on" condition, the electromagnetic device magnetically co-engages the latching means and the catch means with sufficient magnetic force to overcome the first force whereby movement of the catch means away from the received state results in said latching means moving into the capture state. Further, when the electromagnetic device is in the "off" condition, the latching means and the catch means may be disengaged with said latch element remaining in the release state.

The present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed to an electromechanical lock that can be used to selectively two structures together. Thus, the electromechanical lock selectively allows the structures to move apart from one another but will also selectively retain them together in a closed condition. The electromechanical lock of the present invention is particularly adapted as a door lock to selectively lock the door in a closed position yet permit the door to move into an open position relative to its casing. This includes both swinging doors and sliding doors. The present invention includes a door that incorporates the electromechanical lock as well as a system which includes a controller that is connected to a power source so as to control activation and deactivation of the electromechanical lock. The present invention also contemplates a method of electromechanically securing two structures together by the steps inherent in the electromechanical structures described below.

Figure 1:
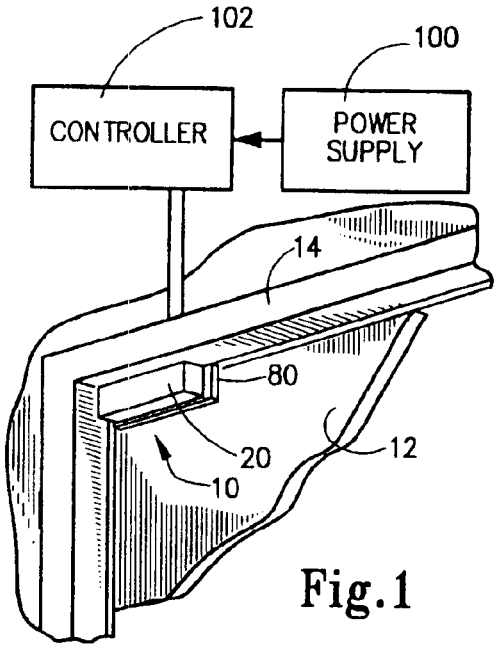
FIG. 1 is a perspective view of the electromechanical lock according to a first exemplary embodiment of the present invention secured to first and second structures with a power supply and controller shown in diagrammatic view therewith.
Figure 2:
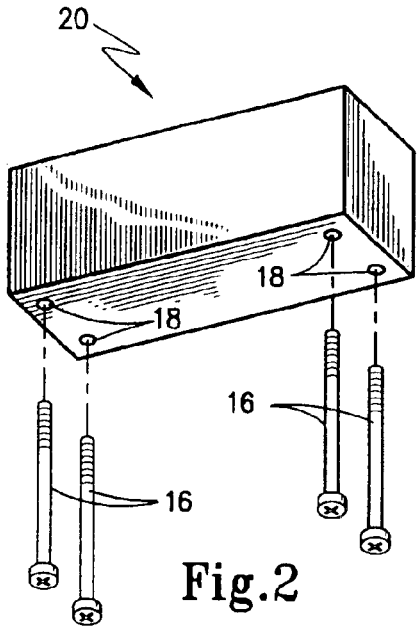
FIG. 2 is a perspective view of the housing which contains the latching assembly according to the first embodiment of the present invention.

A first exemplary embodiment of the present invention is shown in FIGS. 1–17. With reference to FIG. 1, an electromechanical lock 10 is shown attached to a first structure in the form of a door 12 and a casing 14 which, for example, mounts in a structural portion of a building, such as an entryway door opening, an interior door, or the like. Electromechanical lock 10 includes a latching assembly 20 and a catch piece 90 as more thoroughly describe below. By "latching assembly" it is meant any structure that is operative to receive and engage a catch piece and can encompass a multitude of structures as should be understood by the ordinarily skilled person after reading the present disclosure. Likewise, "catch piece" means any piece of desired shape, structure or configuration that is received by the latching assembly and that can be lockably retained thereby in a releasable manner. In order to attach latching assembly 20 to casing 14, a plurality of bolts 16 are provided which extend through bores 18 in latching assembly 20 and mount into the edge of casing 14 as is known in the art. This mounting is similar to existing controlled access security locks of the electromagnetic type.

Figure 3:
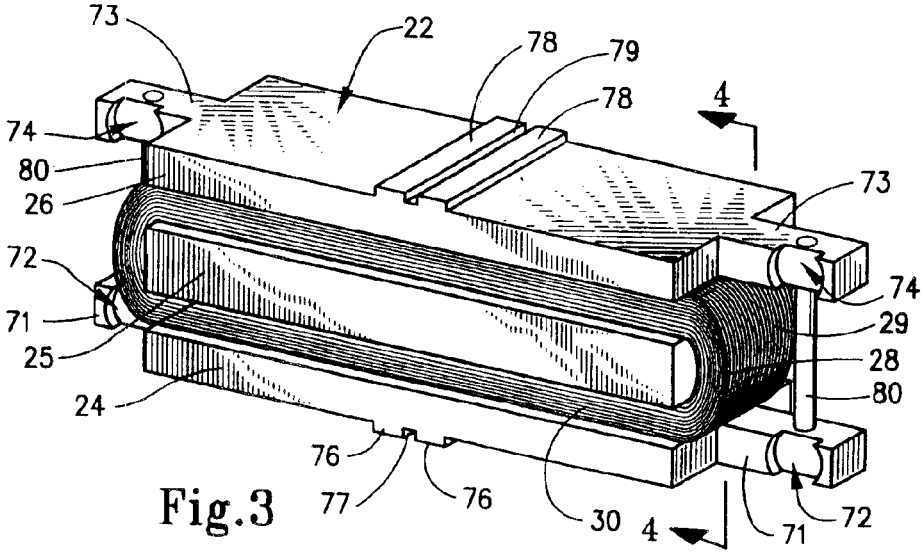
FIG. 3 is a perspective view of the arming element and electromagnetic device according to the first embodiment of the present invention.
Figure 4:
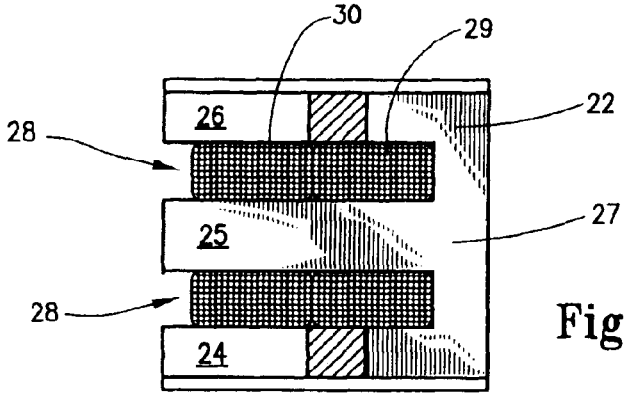
FIG. 4 is a cross-sectional view taken about lines 4—4 of FIG. 3.

An electromagnetic arming member is received in latching assembly 20, and this combination is shown in FIGS. 3 and 4. In these Figures, a core 22 is formed by three fins 24, 25 and 26 joined by a base web 27 along one side thereof. An electrical coil 28 is wound within core 22 such as around fin 25. Electrical coil 28 is preferably a copper winding and can consist of one or a plurality of individual coils such as component coils 29 and 30 formed of suitable conductive windings, usually metal, such as copper. Core 22 can be of any type known in the art and may be solid or laminated as known in the magnetic art. Solid cores are typically made of magnetically permeable materials, laminated cores are typically constructed as flux-directing layers of permeable steel. Core 22 and coil 28 thus form an electromagnet that can be switchable connected to a power supply 100 switchably operated by a controller 102, as is shown in FIG. 1.

Figure 5:
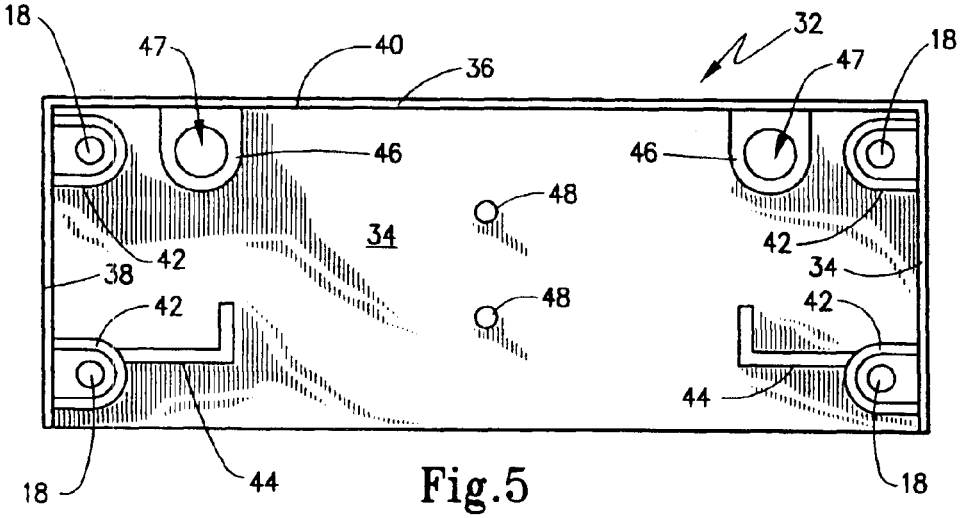
FIG. 5 is a plan view of the base used to form the housing of FIG. 2.
Figure 6:
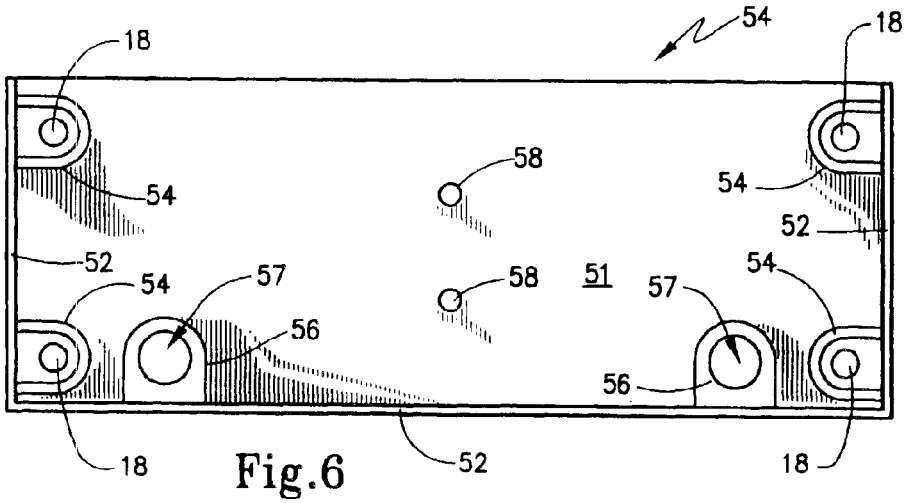
FIG. 6 is a plan view showing the interior of the cover used to form the housing of FIG. 2.

A housing for latching assembly 20 is formed by a base 32 and a cover 50 respectively shown in FIGS. 5 and 6. Base 32 includes a base wall 34 and a side wall 36 formed by side wall portions 38, 39 and 40. Blocks 42 are located at the corners of base 32 and are formed integrally therewith and are provided with bores 18 for bolts 16. An L-shaped rib 44 extends from each of the blocks 42 located at the front of base 32. These ribs 44 project towards one another. A pair of seats 46 are located proximately to each respective block 42 at the rear of base 32 on base wall 34 and side portion 40. Seats 46 each have a cylindrical cavity 47 formed therein. A pair of posts 48 project upwardly of base wall 34 centrally thereof and provide guides, as described below.

With reference now to FIG. 6, cover 50 includes a cover panel 51. Panel 51 that is surrounded on three sides by a side rib 52. Blocks 54 are located at each corner of cover 50 and include bores 18 for bolts 16 noted above. A pair of seats 56 are disposed along a back edge of cover 50 and each have a cylindrical cavity 57 formed therein. A pair of posts 58 are disposed on cover panel 51 and are centrally located thereon and act as guides as described below.

Figure 7:
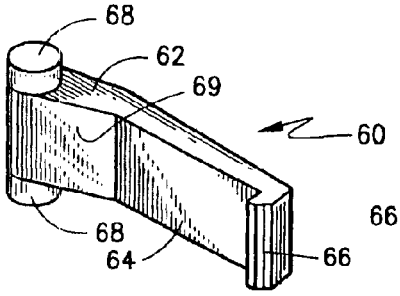
FIG. 7 is a perspective view of a latching element according to the first exemplary embodiment of the present invention.
Figure 8:
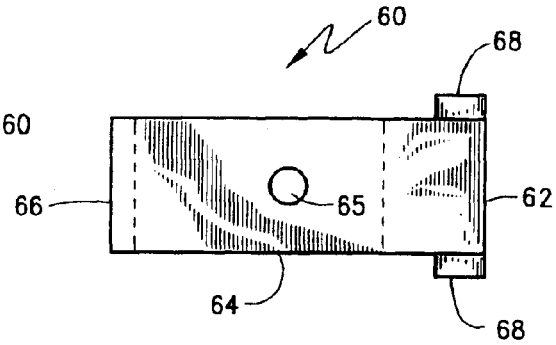
FIG. 8 is a side view in elevation of the latching element of FIG. 7.

A representative latch element for this first embodiment of the present invention is depicted in FIGS. 7 and 8. Here, latch element 60 is in the form of a pawl having a base 62 and an elongated arm 64 that terminates in a hook 66. A pair of oppositely projecting trunnions 68 are cylindrical in configuration and extend oppositely outwardly from base 62. Arm 64 is provided with a post 65 on one side thereof and an inclined plane 69 forms a cam surface, the purpose of which is described in greater detail below.

Figure 9:
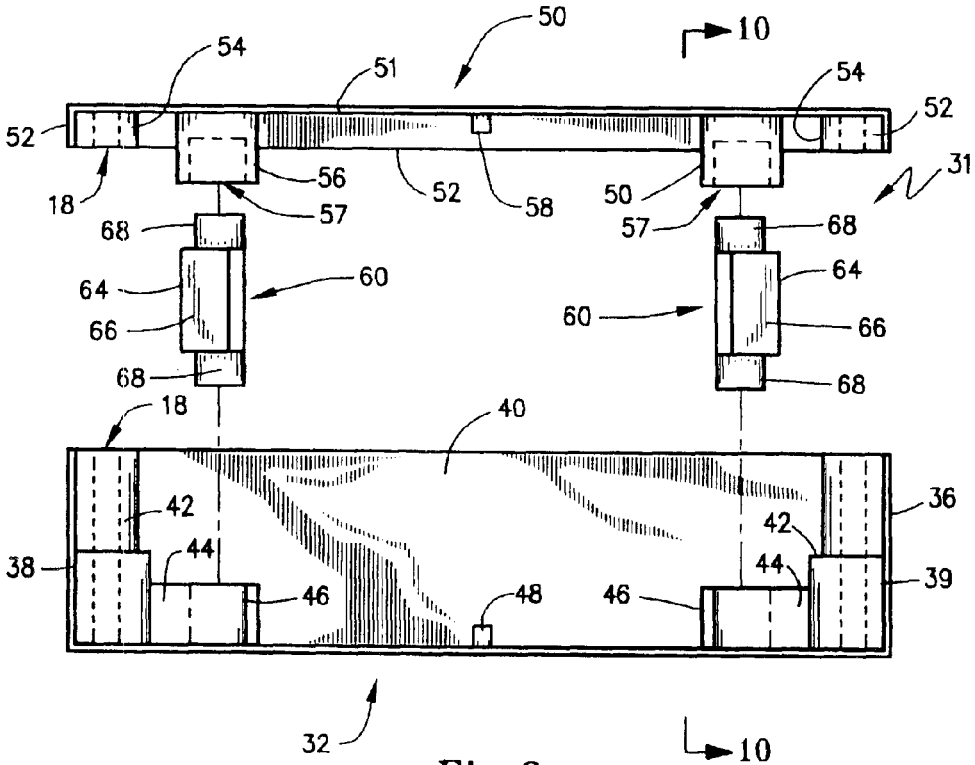
FIG. 9 is an exploded front view in elevation showing the assembly of the base of FIG. 5 with the cover of FIG. 6 along with a pair of latch elements such as those shown in FIGS. 7 and 8.
Figure 10:
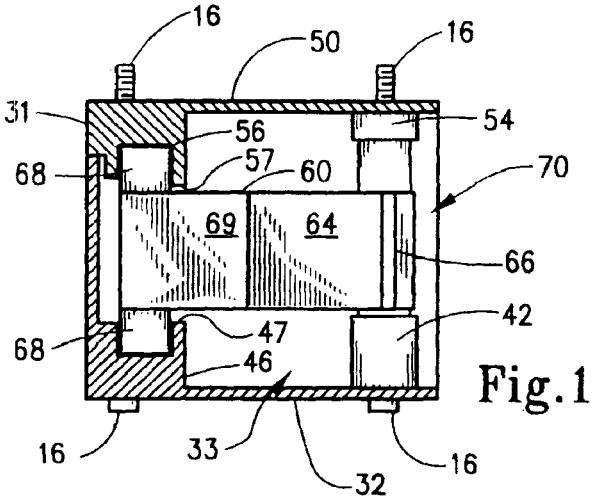
FIG. 10 is an end view in cross-section taken about lines 10—10 of FIG. 9, when assembled.

With reference now to FIG. 9, the assembly of base 32 and cover 50 to form housing 31 along with the mounting of a pair of latch elements 60 is shown. As may be seen in FIG. 9, when cover 50 is placed on base 32, blocks 54 will abut blocks 42 with bores 18 being aligned. It may be here noted that blocks 42 may be tiered, for dimensional reasons, if desired. Each of seats 46 are opposed to a respective seat 56 to form a seat pair for mounting trunnions 68 of each latch element 60. To this end, each of trunnions 68 is received in a respective cylindrical cavity 47, 57 so that latch elements 60 may pivot relative to the housing 31. This mounting is also shown in FIG. 10 and it may be seen that the inclined planes 69 of the pair of latch elements 60 face each other with hook portions 66 also projecting towards one another. By providing the tiering construction of blocks 42 it may be seen that suitable dimensions are provided so that the lower portion of block 42 will not interfere with the pivotal movement of arm 64 of latching element 60. Also in FIG. 10, it may be seen that bolts 16 extend through the housing 31. Furthermore, it may be seen that the mounting of cover 50 to base 32 forms an entryway 70 into the interior 33 of housing 31 in order to dock the catch piece as described below.

Figure 11:
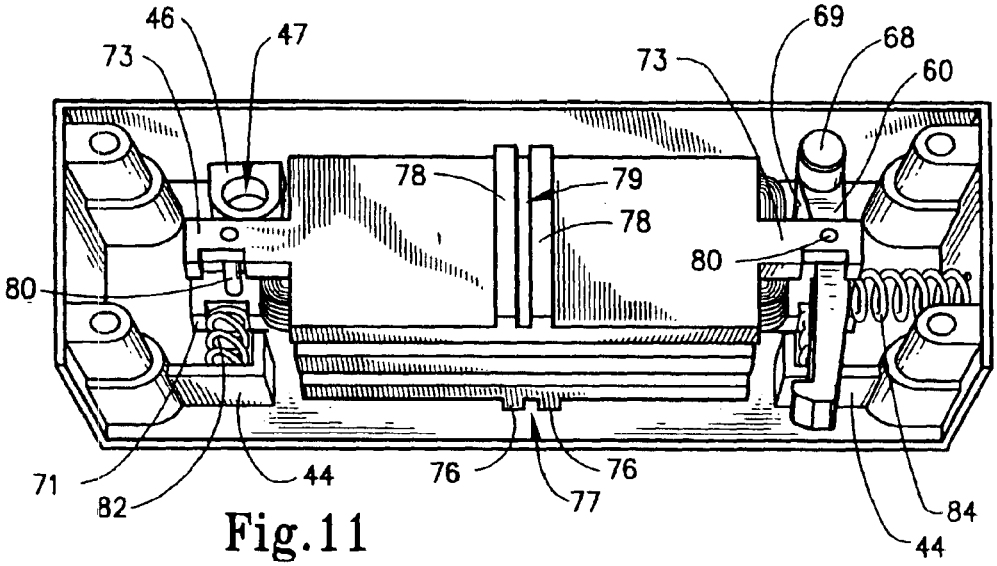
FIG. 11 is a perspective view showing the arming member and the electromagnetic device of FIG. 3 received in the base of FIG. 5 along with one latch element as shown in FIG. 7.

The organization of the elements of latching assembly 20 is shown in FIG. 11. With reference again to FIG. 3 along with FIG. 11, it may be seen that core 22 has a pair of oppositely projecting mounting arms 71 extending from fin 24 and a pair of oppositely projecting mounting arms 73 which project from fin 26. Seats 72 are provided in each arm 71 and seats 74 are provided in each arm 73. A pair of transverse ribs 76 are formed on fin 24 and define a channel 77. Likewise, a pair of parallel ribs 78 are formed on fin 26 and define a channel 79 therebetween. A rod 80 extends between one set of arms 71, 73 and another rod 80 extends between the other set of arms 71, 73.

Figure 12:
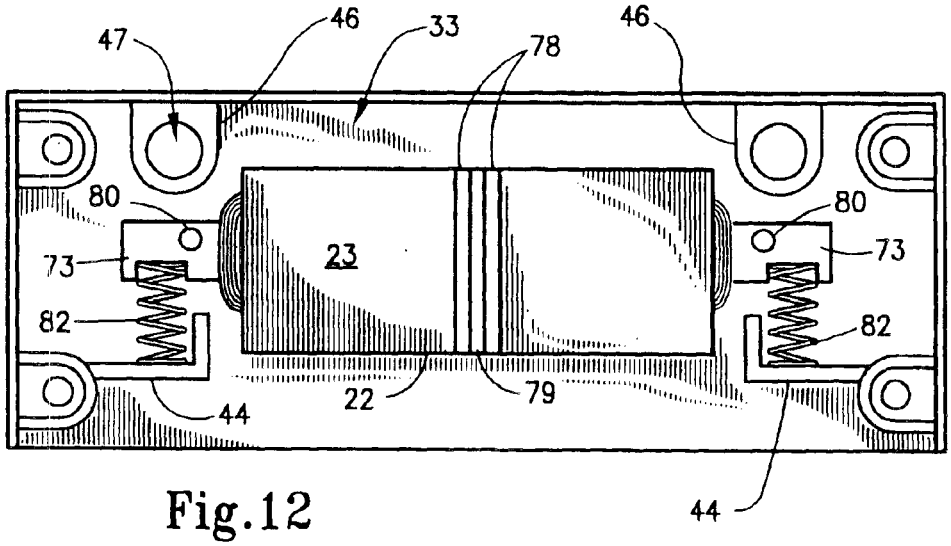
FIG. 12 is a top view in elevation showing the mounting of the arming member and electromagnetic coil of FIG. 3 mounted in the base of FIG. 5.

With reference now to FIGS. 11 and 12, it may be seen that core 22 along with its associated structure may now be referred to as an arming member 23 is mounted in the interior 33 of housing 31 and is held in position and guided by means of posts 48 and 58 (FIGS. 5 and 6) that are respectively received in channels 77 and 79. Arming member 23 is biased into a first position by means of compression springs 82 that extend between each L-shaped rib 44 and a respective arm 71 wherein each spring 82 is received in seat 72 thereof. With reference to FIG. 11, it may be seen that a representative latch element 60 is mounted for rotation between a pair of seats 46 and 56 and is biased into a capture state by means of a compression spring 84. As will now be described, rods 80 along with compression springs 84 act to move latch elements 60 between the capture and release.

Figure 13:
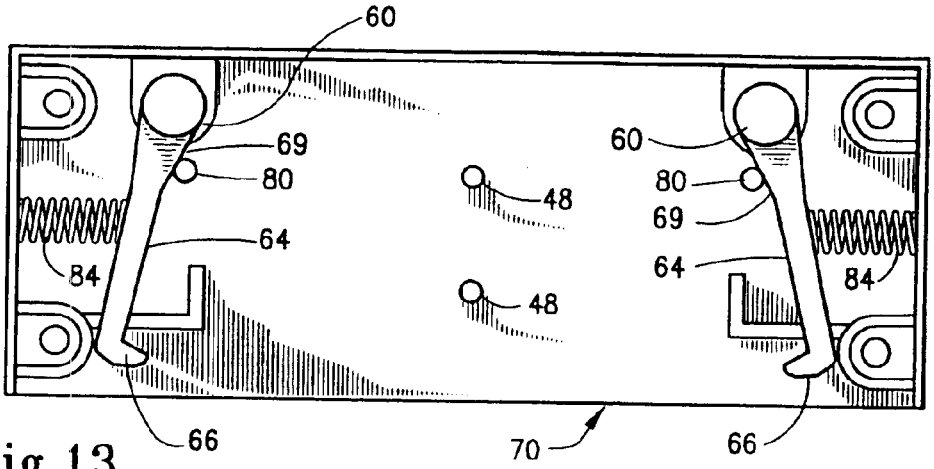
FIG. 13 is a top view in elevation showing a pair of latching elements of FIG. 7 received in the base of FIG. 5 and shown in a release state.
Figure 14:
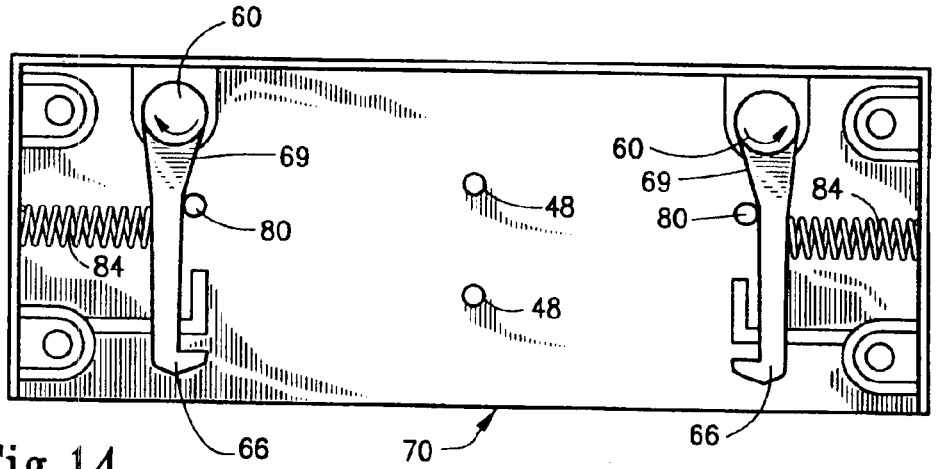
FIG. 14 is a top view in elevation, similar to FIG. 13, but showing the latch elements in a capture state.

With reference, then, to FIGS. 13 and 14, it may be seen that, when arming member 23 is in a first position (FIG. 13), rods 80 bear against inclined planes 69 to force latch elements 60 apart by rotating them against the force of compression springs 84. Arming member 23 is biased into this first position by compression springs 82 which have greater spring constants than springs 84. Accordingly, absent any other forces, arming member will be biased rearwardly into housing 31 and latch elements 60 will be moved into the release state. However, when arming member 23 advances toward the entryway 70, rods 80 likewise move forwardly. This corresponds to the movement of arming member 23 into a second position. When this occurs, rods 80 move along inclined planes 69 to permit compression springs 84 to move latch elements 60 into the capture state, as shown in FIG. 14.

Figure 15:
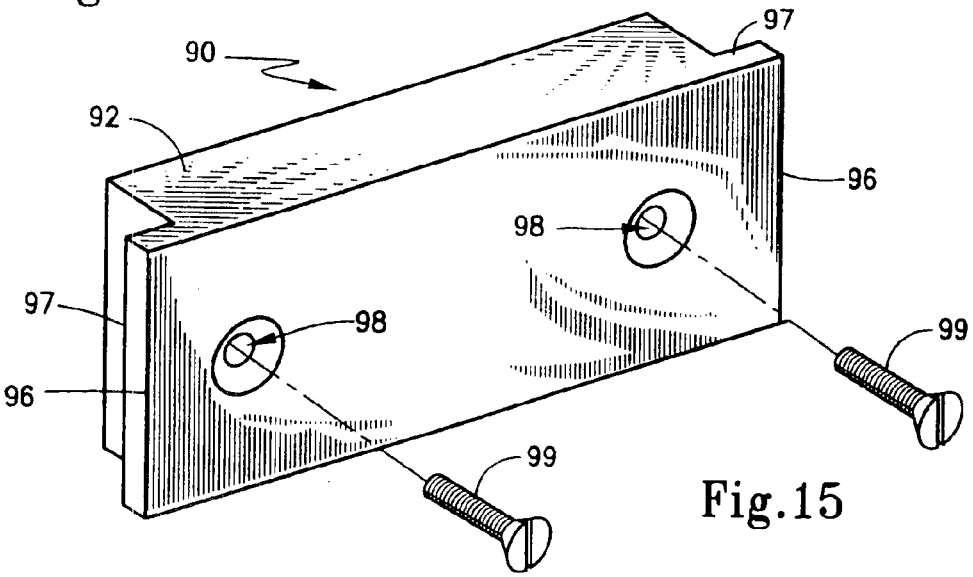
FIG. 15 is a perspective view of a catch element according to an exemplary embodiment of the present invention.

The operation of electromechanical lock 10 will become more apparent after discussing the structure of catch piece 90 that is best shown in FIG. 15. Here, catch piece 90 is in the form of a T-shaped block having a base 92 and a top portion 94 from which a pair of lips 96 oppositely project. Lips 96 form shoulders 97 adapted to be engaged by hook portions 66 of latch elements 60, as described below. Countersunk bores 98 are provided to receive screws 99 for securing catch piece 90 to the second structure portion, such as the door as is shown in FIG. 1. It should be appreciated that catch piece 96 defines an armature, as is known in the art of electromechanical locks, with catch piece 90 being formed as a suitable ferromagnetic material. By this term, "ferromagnetic" it is meant that the substance will be attracted to a magnetic force. Moreover, the term "lips" as used herein refers to any physical structure that can be positively engaged by the latch element, and may include, without limitation, hooks, prongs, loops, flanges, shoulders, cut-outs, etc.

Figure 16:
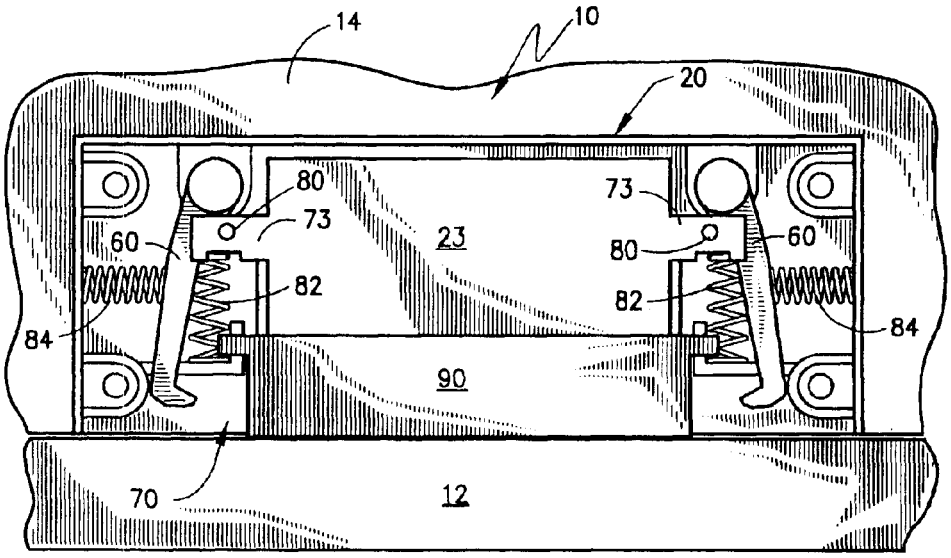
FIG. 16 is a top view in elevation showing the latching assembly mounted on a first structure, such as a door casing, and the catch piece mounted on a second structure, such as a door, with the catch piece being docked in a received state within the latching assembly and with the latch elements in the release position.
Figure 17:
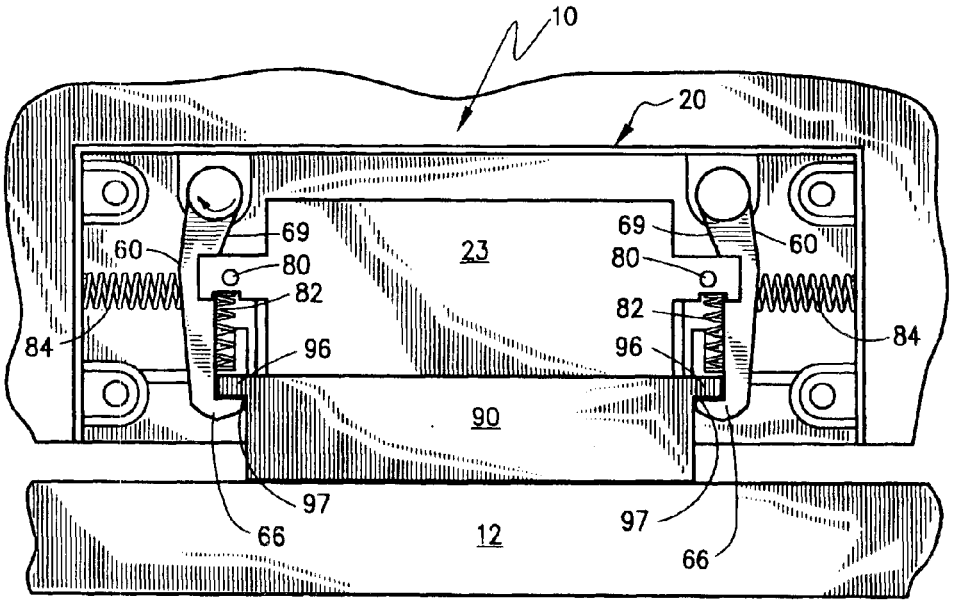
FIG. 17 is a top view in elevation showing the structure of FIG. 16 with the electromagnetic device being placed in the "on" condition and a second structure moved slightly away from the first structure to show the movement of the latch elements into the capture state thereby prevent removal of the catch piece from the receive state.

Finally, turning to FIGS. 16 and 17, the operation of electromechanical lock 10 should be fully appreciated. In FIG. 16, it may be seen that arming member 23 (including core 22, arms 71, arms 73 and rods 80) is biased by compression springs 82 into a first position such that rods 80 acting on inclined surfaces 69 force latch elements 60 apart and thereby compress springs 84. In this position, latch elements 60 are in the release state. Catch piece 90 is docked in a received state through entryway 70 so that it is received in the interior of latching assembly 20. Absent the presence of current running through coil 28, door 12 can swing away from casing 14 since springs 82 maintain latch elements 60 in the release state. However, as is shown in FIG. 17, when an electrical current is present in coil 28, core 22 and coil 28 act as an electromagnet that magnetically retains catch element 90. As door 12 is moved, this magnetic attraction causes arming member 23 to move forwardly toward the second position against the force of springs 82 so that rods 80 move forwardly along inclined planes 69. Thus springs 84 bias latch elements 60 into the capture state. In this state, hook portions 66 of each latch element 60 engage shoulders 97 formed by lips 96 and mechanically constrain further movement of catch piece 90 out of the received state.

It should be understood from the foregoing, then, that the strength of the electromagnet need only be sufficient such that the magnetic force, acting in conjunction with the force of compression springs 84 acting along inclined planes 69 against rods 80 overcomes the compression force of springs 82. With proper selection of the spring constants of springs 82 and 84 along with the dimensioning of inclined plane 69, all which should be within the skill of the ordinarily skilled mechanical engineer, the force of the electromagnet can be small relative to typical magnetic locks. This eliminates the increasingly large and bulky electromagnets used in existing controlled access magnetic locks.

Figure 24:
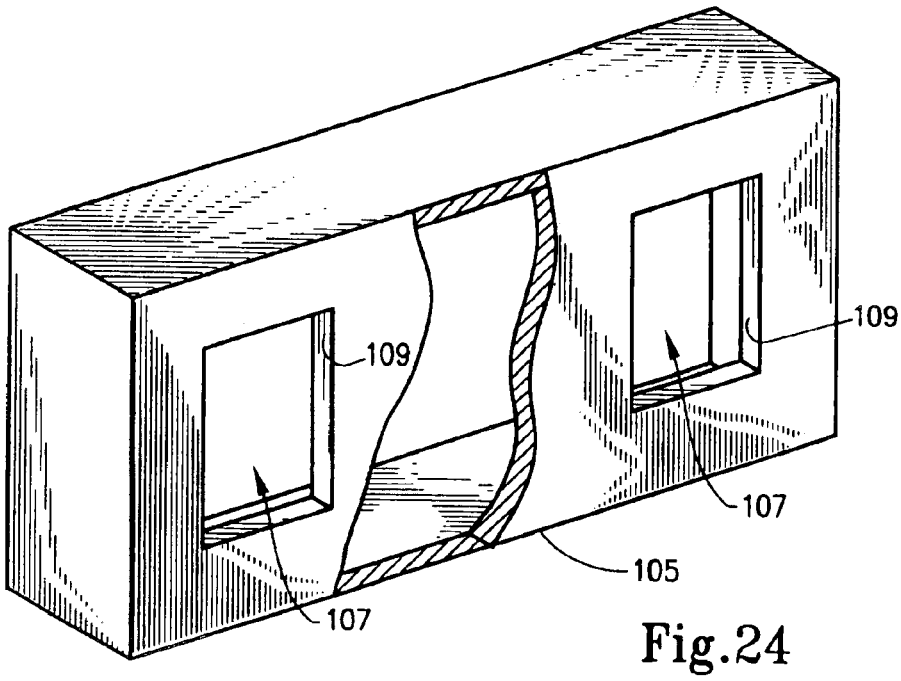
FIG. 24 is a perspective view of an alternative catch piece.

It should be understood that a wide variety of latching elements may be employed with the present invention without departing from the scope thereof. Moreover, a wide variety of arming elements may be used as well as a wide variety of catch pieces. For example, the catch piece could take any shape and have any structure thereon that provides a way of engaging the latch element. For example, as is shown in FIG. 24, instead of lips 96 being oppositely projecting wings, the catch piece 103 may be formed as hollow housing 105 with openings 107 in the face. Thus, the margins of the openings provide peripheral "lips" 109 therearound. In this case, the latching element could extend into the interior of the catch piece 103 and engage the peripheral lip 109 of the opening 107.

Figure 25:
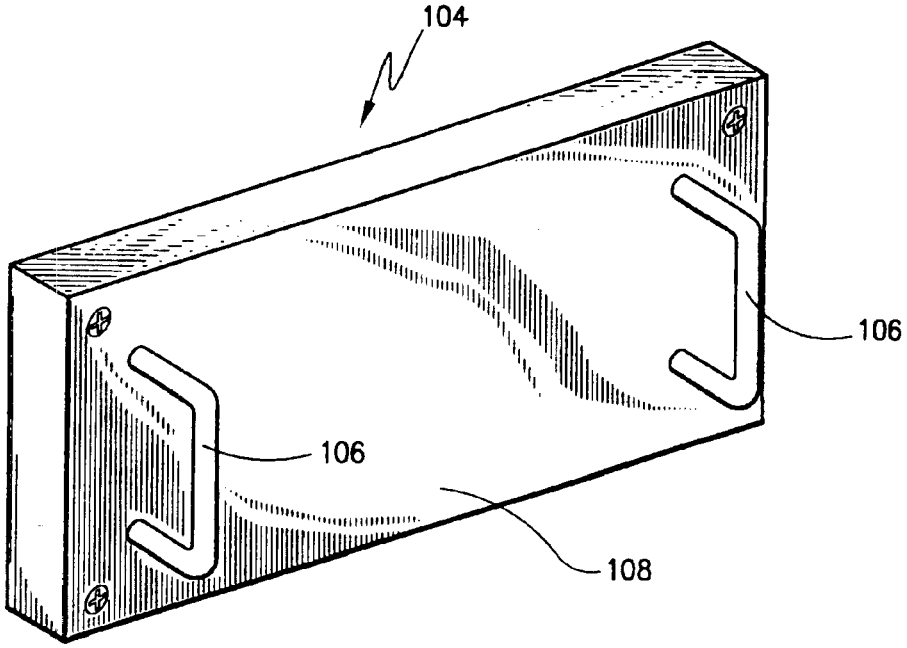
FIG. 25 is a perspective view of yet another alternative catch piece.

The catch could also be configured as arching loops or loop portions that are engaged by the latch elements. Thus, for example, as is shown in FIG. 25, arcuate loops 106 are mounted on plate 108 that defines a catch piece 104. Loops 106 provide "lips" to engage the latching element. It should be understood that FIGS. 24 and 25 and are merely examples of a catch piece and the structure of the same and, as noted above, a wide variety of structures for the catch piece are possible depending upon the structure of the latching assembly.

Figure 18:
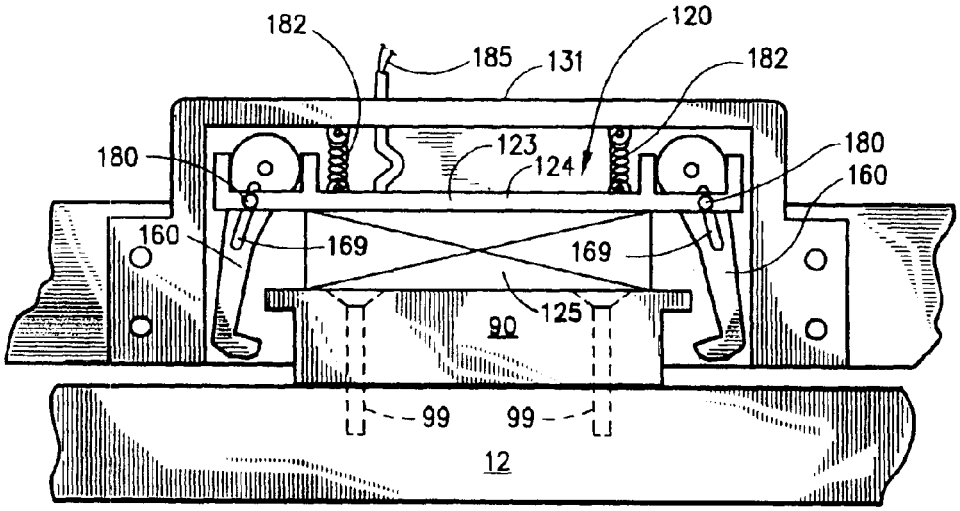
FIG. 18 is a top view in cross-section, similar to FIG. 16 showing a second embodiment of the present invention in the release state.
Figure 19:
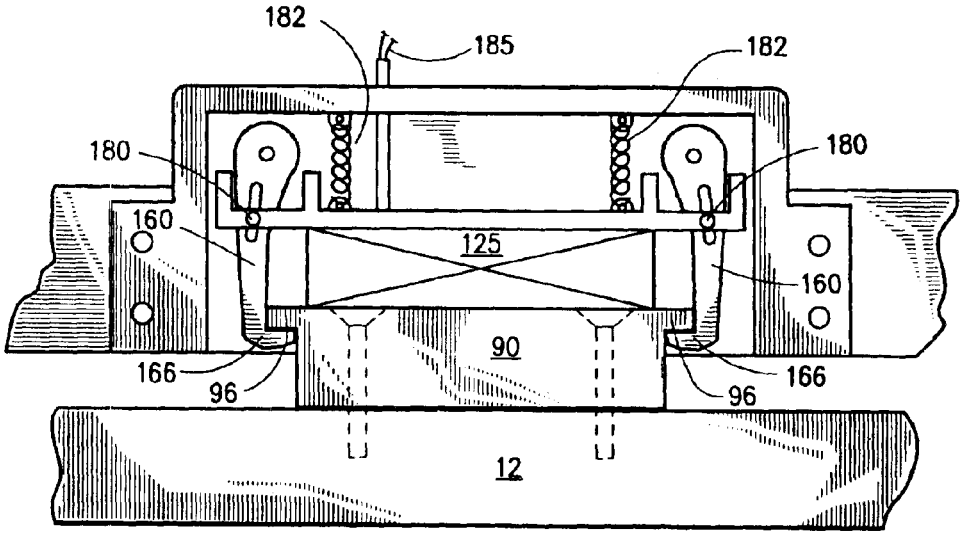
FIG. 19 is a top plan view in elevation, similar to FIG. 18, but showing the latch elements in a capture state to prevent the catch piece from being removed from the receive state in the latching assembly.
Figure 20:
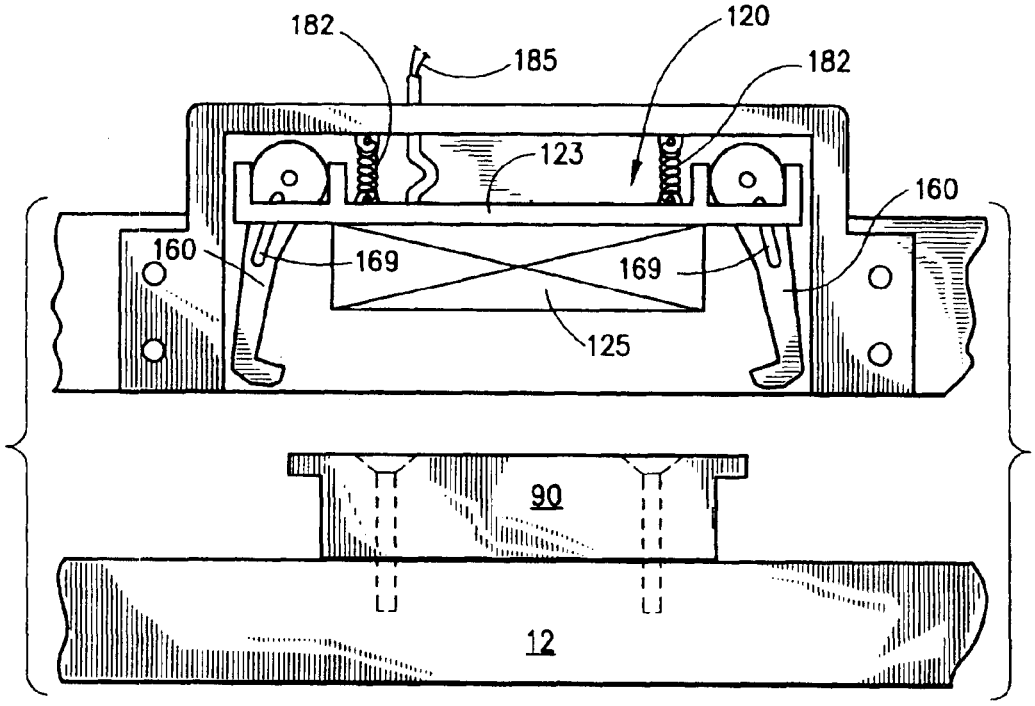
FIG. 20 is a top view in elevation, similar to FIG. 19, but showing the action of electromechanical lock when the electromagnetic device is placed in the "off" condition so that the catch piece may be removed from the latching assembly with the latch elements shown in the release state.

In order to give examples of other latching assemblies, and without in any way intending to limit the various constructions that the ordinarily skilled artisan may develop based on the teachings of this application, alternative structure as shown in FIGS. 18–23. A second embodiment of the present invention is shown in FIGS. 18–20. Here, latching assembly 120 is shown and mounted in a housing 131. Arming member 123 is in the form of a plate 124 that supports an electromagnet 125 thereon. Springs 182 interconnect housing 131 and plate 124 is guided in any suitable manner. Plate 124 is provided with a pair of rods 180 that are received in cam slots 169 formed in arm portions 164 of latch elements 160. This structure eliminates compression springs 84 in the first embodiment.

As is shown in FIGS. 18 and 20, springs 182 bias arming member 123 into the first position. In this position, rods 180 slide in camming slots 169 to force latch elements 160 into the release state. Absent a magnetic force, catch piece 90 may move into the received state as shown in FIG. 18 and out of the received state as shown in FIG. 20. However, when a magnetic current is supplied by wires 185 to electromagnet 125, the magnetic force is sufficient to overcome the force of springs 182. Thus, as is shown in FIG. 19, electromagnet 125 adheres to catch piece 90 with a magnetic force. Thus, as catch piece 90 is attempted to be removed from the received state, rods 180 slide in camming slots 169 positively advancing latch elements 160 into the capture state. In such state, hook portions 166 of latching elements 160 engage lips 96 of catch piece 90.

Figure 21:
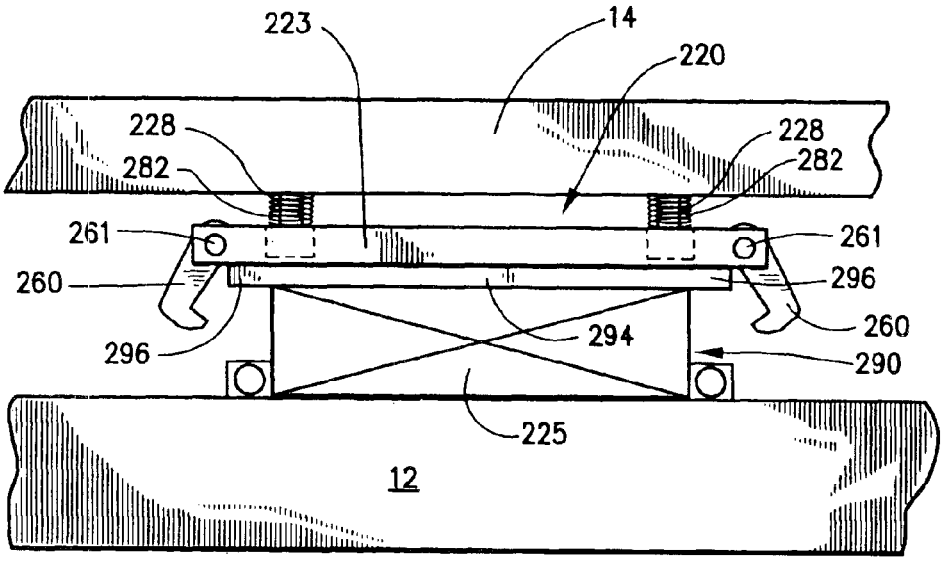
FIG. 21 is a top plan view of yet another alternative embodiment of the present invention, here with the electromagnet being associated with the catch piece.

A third embodiment of the present invention is shown in FIG. 21. Here, it may be seen that the electromagnet 225 is formed as part of the catch piece 290. Head portion 294 provides a pair of lips 296, and it could be understood that catch piece 290 can be formed of a core material for the electromagnetic coils that form electromagnet 225. In any event, latching assembly 220 includes an arming member 223 that is slideably mounted on posts 228 and biased by springs 282 as shown in FIG. 21. Latching elements 260 are pivotally mounted at opposite ends of plate 224 on axles 261 and, when contacted by catch piece 290 are held in the release position (shown in FIG. 21) by means of suitable cam surfaces. Coil springs (not shown but similar to those described below in FIGS. 22 and 23) extend around axles 262 to bias latching members 260 into the capture position. However, due to the action of springs 282, arming member 223 forces cam members 260 into the release position, as described above. When current is applied to electromagnet 225 a magnetic force is added coupling plate 224 and catch piece 290. Thus, the movement of door 12 away from casing 14 causes plate 224 to overcome the force of springs 282 so that catch latch elements 260 will pivot into the capture position as should now be understood by the ordinarily skilled person having read this disclosure.

Figure 22:
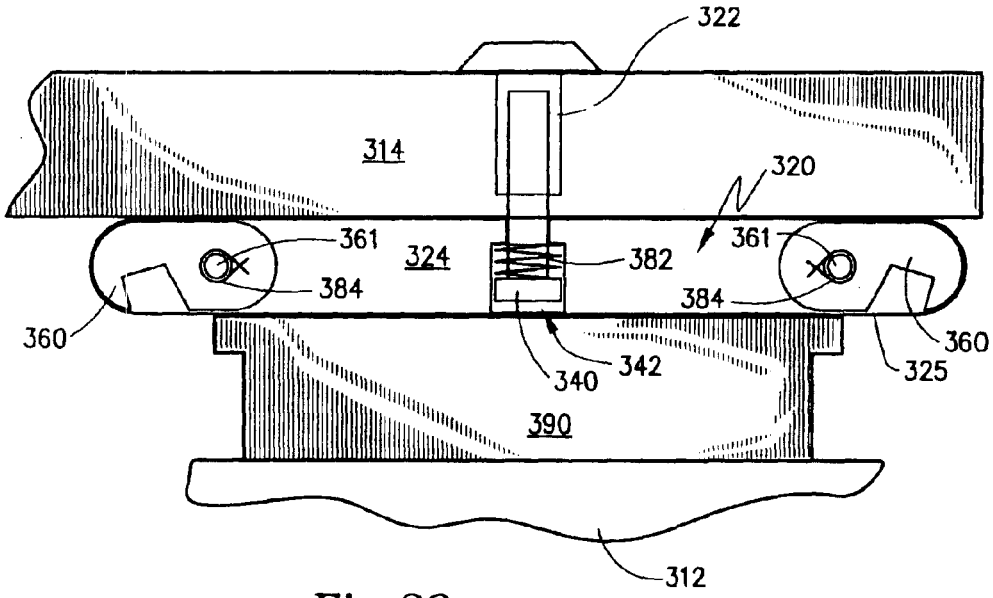
FIG. 22 is a top view in elevation diagramming yet another embodiment of the present invention with the latch pieces shown in the release state.
Figure 23:
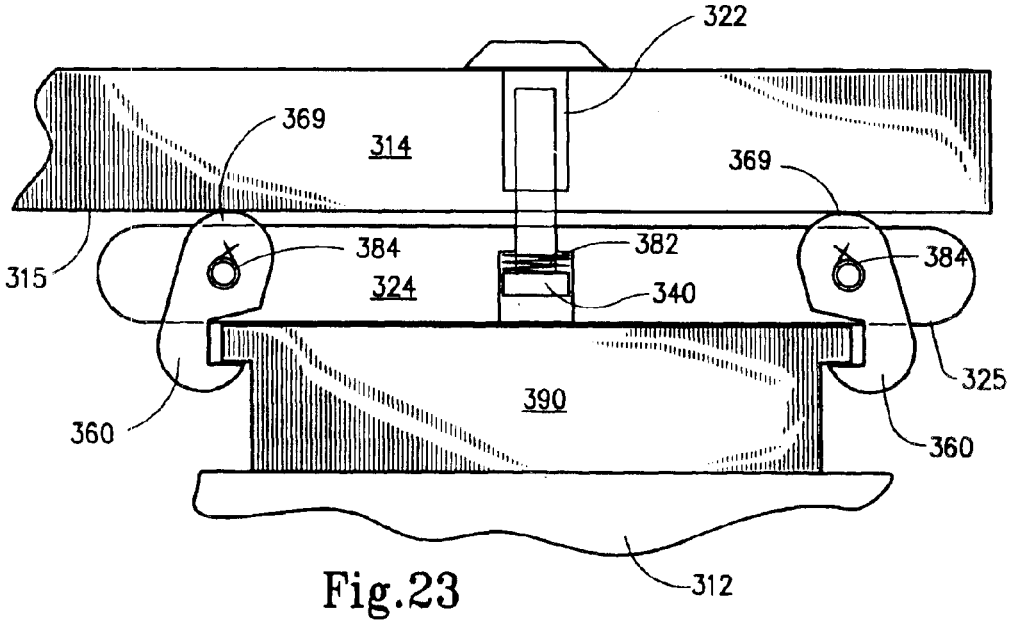
FIG. 23 is a top plan view, similar to FIG. 22, but showing the latch elements moving into the capture state.

Finally, turning to FIGS. 22 and 23, a fourth embodiment of the present invention is shown. Here, latch assembly 320 is in the form of a plate 24 that is mounted to a first structure 314 by means of a bolt 322 that has a base block 340 received in a cavity 342 formed therein. A spring 382 biases plate 320 into the first position adjacent structure 314. Catch 390 is mounted to a second structure 312 and comes into abutment with plate 324 when in a received position in latch assembly 320. Plate 324 has associated therewith an electromagnet 325, and a pair of latch elements 360 are rotatably journaled on axles 361 and are biased into the capture state by means of coil springs 384.

As is shown in FIG. 23, when current is supplied to electromagnet 325, catch piece 390 is magnetically attracted to plate 324. Movement of catch piece 390 away from structural piece 314 moves plate 324 away from piece 314 against the force of compression spring 382. When this occurs, springs 384 act to rotate latch elements 360 into the capture state shown in FIG. 23. Upon the release of the electromagnetic force, however, the first force provided by spring 382 is sufficient to overcome the force of springs 384 so as to draw plate 324 toward structure 314. When this occurs, camming surfaces 369 on the perimeter of latch elements 360 act against the surface 315 to rotate latch elements 360 into the release state shown in FIG. 22. Here, again, the electromagnet could be part of catch piece 390, and the mount for latch element 360 be a plate attracted to the magnetic as in the embodiment of FIG. 21.

From the foregoing, it should be understood that the present invention includes a method for electromechanically locking first and second structures together so that, when in a second state, they are permitted to move apart from one another and when in a first state are prevented from moving apart from one another. This method includes all of the steps inherent in the structures described above, taken in any suitable operative order. Broadly, however, the general method of the present invention includes the step of mounting a latching means including at least one mechanical latch element on the first structure with this latch element movable between a capture state and a release state. The method includes a step of biasing the latching element into the release state with a first force. The method includes the mounting of a catch means on the second structure. The method for electromechanically locking includes the docking of the catch means and the latch means together in a received state. The method includes the step of electromechanically coupling the latch means and the catch means with an electromagnetic device that is switchable between an "on" condition and an "off" condition. This step is accomplished such that, when the electromagnetic device is in the "on" condition, the electromagnetic device magnetically co-engages the latching means and the catch means with sufficient magnetic force to overcome the first force whereby movement of the catch means away from the received state results in the latching means moving into the capture state. Alternatively, when the electromagnetic device is in the "off" condition, the latching means and the catch means may be disengaged with the latch element remaining in the release state.

Accordingly, the present invention has been described with some degree of particularity directed to the exemplary embodiments of the present invention. Modifications or changes may be made to the exemplary embodiments of the present invention without departing from the inventive concepts contained herein.

I claim:

1. An electromechanical lock adapted to selectively permit first and second structures from moving apart from one another when in a first state and to prevent said first and second structures from moving apart when in a second state, comprising:

(a) a housing having an interior with an entryway and adapted to mount on said first structure;

(b) a latching assembly disposed in the interior of said housing, said latching assembly including:

(1) a pair of opposed latch elements each movable between a capture state and a release state;

(2) a pair of spring elements each operative to bias a respective one of said latch elements into the capture state;

(3) an arming member movable between a first position and a second position, (i) said arming member including a pair of pins each operative when said arming member is in the first position to engage a respective one of said latch elements whereby said latch element is in the release state, (ii) each said pin permitting its respective said latch element to move into the capture state when said arming member is in the second position, (4) a biasing element associated with said arming member and operative to urge said arming element into the first position with a first force, (c) an armature adapted to mount on said second structure, said latching assembly and said armature positionable such that said armature can be docked in the entryway in a received state relative to said latching assembly; and (d) an electromagnetic device disposed on said arming element, said electromagnetic device being switchable between an "on" condition and an "off" condition such that when said armature is in the received state and said electromagnetic device is in an "on" condition, said electromagnetic device being operative to magnetically engage said armature with a sufficient magnetic force to overcome said first force whereby movement of said armature away from the received state causes said arming element to move into the second position and said latching elements to move into the capture state.

2. An electromechanical lock according to claim 1 wherein said electromagnetic device is secured to said arming member and wherein a portion of said arming member forms a core for said electromagnetic device.

3. An electromechanical lock according to claim 1 wherein each said latch element is formed as a pawl having a slotted opening, said pins being received in a the slotted opening of a respective latch element and operative to move said latch element between the release state and the capture state when said arming member moves between the first and second positions.

4. An electromechanical lock according to claim 1 wherein said housing includes a base and a cover, said base including a base wall and a side wall, said base and said cover securable to one another to define an interior region having an entryway sized to receive said armature therein, said latching assembly disposed in said housing.

5. An electromechanical lock according to claim 4 wherein said latch elements each includes a pair of oppositely projecting trunnions and wherein said base wall and said cover are in spaced-apart opposed relation to one another, said base wall and said cover each being provided with seats that rotatably mount said trunnions.

6. An electromechanical lock according to claim 1 wherein each said latch element is formed as a pawl having a cam surface that acts to move said latch element between the release and capture states.

7. An electromechanical lock according to claim 6 wherein the cam surface is formed by an inclined plane portion on said latch element, said pins each operative to slide along a respective inclined plane to allow said latch element to move between the release state and the capture state when said arming member moves between the first and second positions.

8. An electromechanical locking system adapted to connect to a source of electrical power and selectively permit first and second structures from moving apart from one another when in a first state and to prevent said first and second structures from moving apart when in a second state, comprising:

(a) a latching assembly adapted to mount on said first structure;

(b) a catch piece adapted to mount on said second structure, said latching assembly and said catch piece positionable such that said catch piece can be docked in a received state relative to said latching assembly, said latching assembly including:

(1) at least one latch element movable between a capture state wherein said catch piece becomes mechanically engaged thereby and a release state wherein said catch piece is disengaged thereby;

(2) an arming member movable between a first position and a second position, (i) said arming member when in the first position engaging said latch element whereby said latch element is in the release state, (ii) said arming member when in the second position permitting said latch element to move into the capture state, (c) a biasing element associated with said arming member and operative to urge said arming member into the first position with a first force, (d) an electromagnetic device that is switchable between an "on" condition and an "off" condition such that when said catch piece is in the received state and said electromagnetic device is in an "on" condition, said electromagnetic device operative to magnetically engage said arming member and said catch piece with a sufficient magnetic force to overcome said first force whereby movement of said catch piece away from the received state results in said latch element moving into the capture state; and (e) a controller operative to selectively switch said electromagnetic device between the "on" and "off" conditions.

9. An electromechanical locking system according to claim 8 wherein said catch piece is formed as an armature plate that includes a lip portion operative to be engaged by said latch element when in the capture state.

10. An electromechanical locking system according to claim 8 wherein said electromagnetic device is secured to said catch piece.

11. An electromechanical locking system according to claim 8 wherein said electromagnetic device is secured to said arming member.

12. An electromechanical locking system according to claim 11 wherein a portion of said arming member forms a core for an electrically conductive coil.

13. An electromechanical locking system according to claim 8 wherein said latch element is biased toward the capture state.

14. An electromechanical locking system according to claim 13 wherein said latch element is formed as a pawl having a cam surface that acts to move said latch element between the release and capture states.

15. An electromechanical locking system according to claim 8 including a pair of latching elements, each said latch element movable between a capture state wherein said catch piece becomes mechanically engaged thereby and a release state wherein said catch piece is disengaged thereby, said arming member when in the first position engaging each said latch element whereby each said latch element is in the release state and when in the second position permitting each said latch element to move into the capture state.

16. An electromechanical locking system according to claim 15 wherein each said latch element is formed as a pawl having a cam surface that acts to move said latch element between the release and capture states.

17. An electromechanical lock according to claim 16 wherein the cam surface is formed by an inclined plane portion on each said latch element, said arming member including a portion that slides along the inclined plane to allow said latch elements to move between the release state and the capture state when said arming member moves between the first and second positions.

18. An electromechanical lock according to claim 15 wherein each said latch element is formed as a pawl having a slotted opening, said arming member including pins that are respectively received in the slotted openings and that act to move said latch elements between the release state and the capture state when said arming member moves between the first and second positions.

19. An electromechanical lock adapted to selectively permit first and second structures from moving apart from one another when in a first state and to prevent said first and second structures from moving apart when in a second state, comprising:

(a) a latching assembly adapted to mount on said first structure;

(b) a catch piece adapted to mount on said second structure, said latching assembly and said catch piece positionable such that said catch piece can be docked in a received state in said latching assembly, said latching assembly including:

(1) at least one latch element movable between a capture state wherein said catch piece becomes mechanically engaged thereby and a release state wherein said catch piece is disengaged thereby;

(2) an arming member movable between a first position and a second position, (i) said arming member when in the first position engaging said latch element whereby said latch element is in the release state, (ii) said arming member when in the second position permitting said latch element to move into the capture state, (3) a biasing element associated with said arming member and operative to urge said arming member into the first position with a first force, and (c) an electromagnetic device that is switchable between an "on" condition and an "off" condition such that when said catch piece is in the received state and said electromagnetic device is in an "on" condition, said electromagnetic device is operative to magnetically engage said arming member and said catch piece with sufficient magnetic force to overcome said first force whereby movement of said catch piece away from the received state results in said latch element moving into the capture state.

20. An electromechanical lock according to claim 19 wherein said catch piece is formed as an armature plate that includes a lip portion operative to be engaged by said latch element when in the capture state.

21. An electromechanical lock according to claim 19 wherein said electromagnetic device is secured to said catch piece.

22. An electromechanical lock according to claim 19 wherein said arming member is spring-biased into the first position.

23. An electromechanical lock according to claim 19 including a housing that includes a base and a cover, said base including a base wall and a side wall, said base and said cover securable to one another to define an interior region having an entryway sized to receive said catch piece therein, said latching assembly disposed in said housing.

24. An electromechanical lock according to claim 23 wherein said latch element is mounted for pivotal movement relative to said housing.

25. An electromechanical lock according to claim 24 wherein said latch element includes a pair of oppositely projecting trunnions and wherein said base wall and said cover are in spaced-apart opposed relation to one another, said base wall and said cover each being provided with seats that rotatably mount said trunnions.

26. An electromechanical lock according to claim 19 wherein said electromagnetic device is secured to said arming member.

27. An electromechanical lock according to claim 26 wherein a portion of said arming member forms a core for an electrically conductive coil.

28. An electromechanical lock according to claim 19 wherein said latch element is biased toward the capture state.

29. An electromechanical lock according to claim 28 wherein said latch element is formed as a pawl having a cam surface that acts to move said latch element between the release and capture states.

30. An electromechanical lock according to claim 29 wherein the cam surface is formed by an inclined plane portion on said latch element, said arming member including a portion that slides along the inclined plane to allow said latch element to move between the release state and the capture state when said arming member moves between the first and second positions.

31. An electromechanical lock according to claim 19 wherein said latch element is formed as a pawl having a slotted opening, said arming member including a portion that is received in the slotted opening and that acts to move said latch element between the release state and the capture state when said arming member moves between the first and second positions.

32. An electromechanical lock according to claim 31 wherein said electromagnetic device is secured to said catch piece.

33. An access door for an opening in a structure, comprising (a) a casing adapted to mount in the opening;

(b) a door adapted to mount in said casing and movable between an open state and a closed state;

(c) a latching assembly adapted to mount on a first one of said casing and said door;

(d) a catch piece adapted to mount on a second one of said casing and said door, said latching assembly and said catch piece positionable such that said catch piece can be docked in a received state in said latching assembly, said latching assembly including:

(1) at least one latch element movable between a capture state wherein said catch piece becomes mechanically engaged thereby and a release state wherein said catch piece is disengaged thereby;

(2) an arming member movable between a first position and a second position, (i) said arming member when in the first position engaging said latch element whereby said latch element is in the release state, (ii) said arming member when in the second position permitting said latch element to move into the capture state, (3) a biasing element associated with said arming member and operative to urge said arming member into the first position with a first force, and (c) an electromagnetic device that is switchable between an "on" condition and an "off" condition such that when said catch piece is in the received state and said electromagnetic device is in an "on" condition, said electromagnetic device is operative to magnetically engage said arming member and said catch piece with sufficient magnetic force to overcome said first force whereby movement of said catch piece away from the received state results in said latch element moving into the capture state.

34. An access door according to claim 33 wherein said catch piece is formed as an armature plate that includes a lip portion operative to be engaged by said latch element when in the capture state.

35. An access door according to claim 33 wherein said electromagnetic device is secured to said arming member.

36. An access door according to claim 35 wherein a portion of said arming member forms a core for an electrically conductive coil.

37. An access door according to claim 33 wherein said electromagnetic device is secured to said catch piece.

38. An access door according to claim 33 wherein said latch element is biased toward the capture state.

39. An access door according to claim 38 wherein said latch element is formed as a pawl having a cam surface that acts to move said latch element between the release and capture states.

40. An access door according to claim 33 including a pair of latching elements, each said latch element movable between a capture state wherein said catch piece becomes mechanically engaged thereby and a release state wherein said catch piece is disengaged thereby, said arming member when in the first position engaging each said latch element whereby each said latch element is in the release state and when in the second position permitting each said latch element to move into the capture state.

41. An access door according to claim 40 wherein each said latch element is formed as a pawl having a cam surface that acts to move said latch element between the release and capture states.

42. An access door according to claim 41 wherein the cam surface is formed by an inclined plane portion on each said latch element, said arming member including a portion that slides along the inclined plane to allow said latch elements to move between the release state and the capture state when said arming member moves between the first and second positions.

43. An access door according to claim 40 wherein each said latch element is formed as a pawl having a slotted opening, said arming member including pins that are respectively received in the slotted openings and that act to move said latch elements between the release state and the capture state when said arming member moves between the first and second positions.

44. An electromechanical lock adapted to selectively permit first and second structures from moving apart from one another when in a first state and to prevent said first and second structures from moving apart when in a second state, comprising:

(a) a latching means adapted to mount on said first structure;

(b) a catch means adapted to mount on said second structure, (1) said latching means and said catch means for engaging one another when said catch means is docked in a received state relative to said latching means, (2) said latching means movable between a capture state wherein said catch means becomes mechanically engaged thereby and a release state wherein said catch piece is disengaged thereby;

(c) biasing means for urging said latching means into the release state with a first force; and (d) electromagnetic means that is switchable between an "on" condition and an "off" condition such that when said catch piece is in the received state and said electromagnetic device is in an "on" condition, said electromagnetic device magnetically co-engages said latching means and said catch means with a sufficient magnetic force to overcome said first force whereby movement of said catch means away from the received state results in said latching means moving into the capture state.

45. A method for electromechanically locking first and second structures together when in a second permitting said first and second structures to move apart when in a first state, comprising:

(a) mounting a latching means including at least one mechanical latch element on said first structure, (1) said latch element movable between a capture state and a release state;

(b) biasing said latching element into the release state with a first force;

(c) mounting a catch means on said second structure;

(d) docking said catch means and said latch means together in a received state; and (e) electromechanically coupling said latch element and said catch means with an electromagnetic device that is switchable between an "on" condition and an "off" condition whereby (1) when said electromagnetic device is in the "on" condition, said electromagnetic device magnetically co-engages said latching means and said catch means with a sufficient magnetic force to overcome said first force whereby movement of said catch means away from the received state results in said latching means moving into the capture state, and (2) when said electromagnetic device is in the "off" condition, said latching means and said catch means may be disengaged with said latch element remaining in the release state.

* * * * *